US006276974B1

(12) United States Patent
Bouge et al.

(10) Patent No.: US 6,276,974 B1
(45) Date of Patent: Aug. 21, 2001

(54) SWITCH SYSTEM FOR PREVENTING MARINE PROPELLER INJURIES

(75) Inventors: Harry A. Bouge, Susanville; Donald T. Steep, Anderson, both of CA (US)

(73) Assignee: Propguard, Inc., Anderson, CA (US)

( * ) Notice: Subject to any disclaimer, the term of this patent is extended or adjusted under 35 U.S.C. 154(b) by 0 days.

(21) Appl. No.: 09/372,401

(22) Filed: Aug. 10, 1999

(51) Int. Cl.[7] ..... B63H 21/00; B63B 17/00
(52) U.S. Cl. ..... 440/1; 114/362
(58) Field of Search ..... 440/1; 114/362

(56) References Cited

U.S. PATENT DOCUMENTS 2,124,497 * 7/1938 Slauson ..... 440/1
3,774,720 11/1973 Hovey ..... 182/91
3,881,443 * 5/1975 Hamp ..... 440/1
5,105,755 4/1992 Davidson ..... 114/343

* cited by examiner

*Primary Examiner*—Sherman Basinger
(74) *Attorney, Agent, or Firm*—Theodore J. Bielen, Jr.

(57) ABSTRACT

A system to prevent injuries due to marine propellers striking swimmers and other persons in the water next to a boat utilizing a switch. The switch is normally in a closed position and is only opened when a movable element such as a ladder, gate, and the like on the boat travels to an unlatched position. Such movement interrupts the ignition circuit of the boat motor. An override device is also employed to allow normal operation of the marine engine and requires both mechanical and electrical interconnection or matting of connector elements.

12 Claims, 2 Drawing Sheets

SWITCH SYSTEM FOR PREVENTING MARINE PROPELLER INJURIES

BACKGROUND OF THE INVENTION

The present invention relates to a novel and useful safety system to aid in boating safety, specifically to avoid propeller contacting persons in the water.

Marine accidents due to a propeller of a boat striking a swimmer, diver, water skier, and like persons in the water have occurred in the past with devastating consequences. In general, such accidents occur when the operator of a boat is unaware of the presence of such persons in the water in the vicinity of the boat. In many cases, the person being injured is associated with the party of persons in the boat having the errant propeller.

It has been found that associating the operation of the ignition system of the motor of the boat, be it an inboard motor or a outboard motor, to the unlatching or extension of a gate or ladder, respectively, has met with some success. For example, U.S. Pat. Nos. 3,774,720 and 5,105,755 describe safety switch system for marine vehicles in which the ignition system is linked to the extension of a ladder or the latching or unlatching of a gate, or a series of gates. However, such systems may be easily overridden by the simple pressing of a switch. Unfortunately, a simple switch override often results in the same type of accident because such overriding is accomplished quickly and easily.

A safety system for a boat to prevent propeller injuries to persons in the water would be a notable advance in the field of water safety.

BRIEF SUMMARY OF THE INVENTION

The present invention relates to a novel and useful safety system for a boat.

The system of the present invention is used with a marine vehicle having a motor and an element movable between a latched and unlatched position for gaining access to the boat. For example, such movable element may be a gate, a ladder, a hatch, and the like. The boat also includes an ignition circuit for starting the motor, which drives the propeller. The motor of the boat may be an inboard or outboard motor.

The system includes a switch which is normally in a closed position. The switch is opened when the movable element travels to the unlatched position. At that point, the switch interrupts the ignition circuit of the motor. Thus, the movable element must be latched or travel to the latched position before the ignition circuit will permit the motor to run.

The system of the present invention also includes an override device for the switch. The override device includes first connector means and second connector means. The first and second connector means are necessarily mechanically and electrically connected by manual mating. Such manual mating bypasses the switch associated with the movable element. Further, the manual disconnecting, or unmating, of the first and second connector means and, in certain cases, the mechanical and electrical connection of a pair of connectors to one another overrides the switch, allowing the ignition system to operate. The first and second connector means may comprise first and second connectors having male and female configurations. In addition, a relay may be mechanically and electrically linked to the switch and the first and second connector means. The battery of the ignition system of the boat would provide the electrical motivation needed to operate the relay.

In certain cases, the first and second connector means may each include a pair of connectors which must be manually mated to provide the mechanical and electrical linking to the switch, and require the physical unmating and reconnecting to one another to provide such override. The override device may be located in a housing, which could be locked or latched in a particular way, preferably with a warning indicia to insure that one overriding the system checks the water in the immediate vicinity of the boat before starting the engine.

It may be apparent that a novel and useful safety system for a boat has been herein described.

It is therefore an object of the present invention to provide a safety system for a boat which interrupts the operation of the ignition system of the motor of the boat when gate or ladder is open or extended, as the case may be, due to a person entering the water in the vicinity of the boat.

Another object of the present invention is to provide a safety system for a boat which immobilizes the ignition system of the boat when a boat ladder or gate is opened and is not easily overridden by a simple switch, requiring the physical disconnecting and matting of one or more electrical connectors.

Another object of the present invention is to provide a safety system for a boat which is easily retrofitted to boats and may be employed in multiple locations in the boat.

A further object of the present invention is to provide a safety system for a boat which immobilizes the ignition system of a boat when a person is in the vicinity of the boat to prevent injuries due to the boat propeller striking the person in the water.

Another object of the present invention is to provide a safety system for a boat in which it immobilizes the ignition system of a boat that may be overridden if the safety system is damaged in some manner.

Another object of the present invention is to provide a safety system for a boat which is capable of immobilizing the ignition system of a boat to prevent injuries to persons in the water in the vicinity of the boat which conforms to boats of any size and to boats having a variety of motor types.

Another object of the present invention is to provide a safety system for a boat to prevent propeller injuries to persons in the water that is relatively low cost to install and maintain.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the heretofore described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior delineated drawings.

Figure 1:
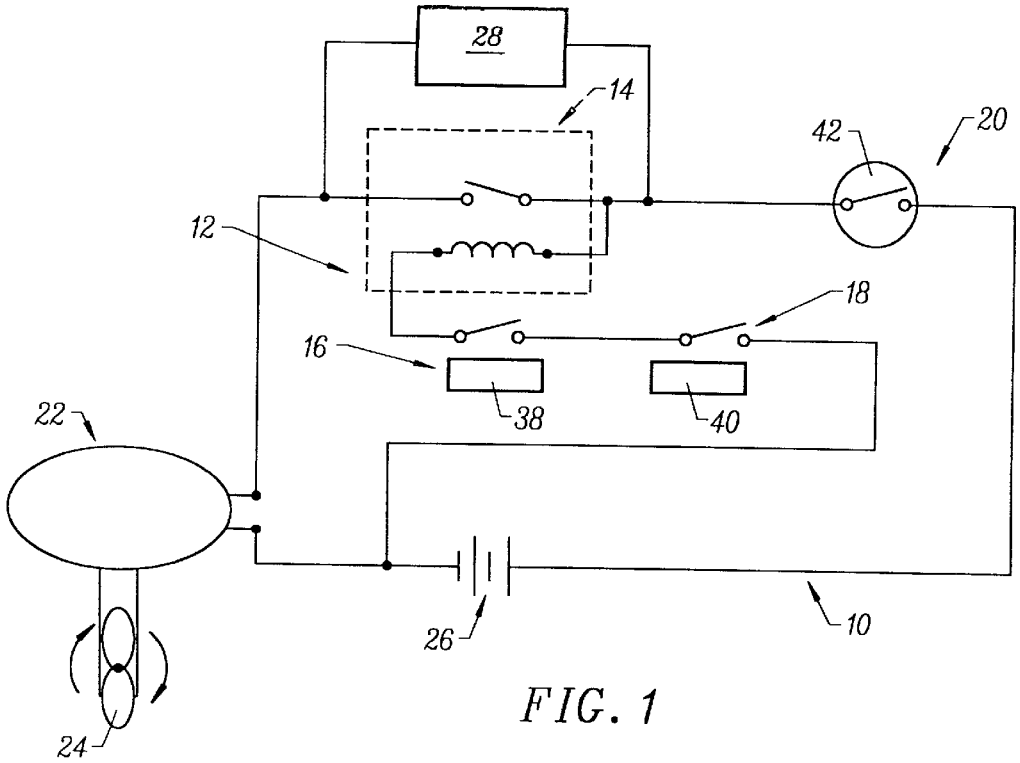
FIG. 1 is a schematic view of the safety system of the present invention in a boat having an inboard motor system.

The invention as a whole is shown in the drawings by reference character 10. The safety system 10 is depicted schematically in FIG. 1 and includes one of its elements switching means 12. Switching means 12 encompasses relay 14 and reed switches 16 and 18. Switch means 12 is used in conjunction with ignition circuit 20 which propels marine motor 22 having rotating propeller 24. Battery 26 powers ignition system 20. An override device 28, illustrated schematically in FIG. 1, is also employed in system 10, and will be discussed in greater detail hereinafter.

Figure 2:
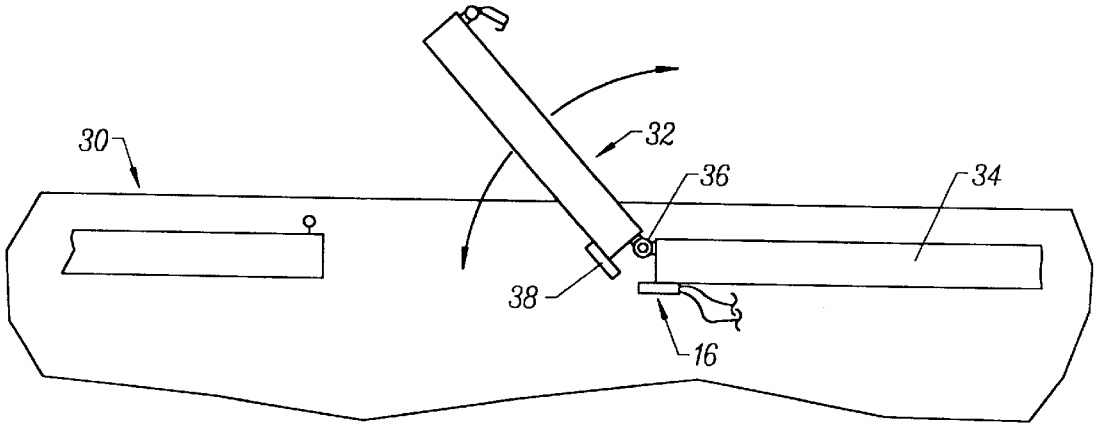
FIG. 2 is a side view of a movable element of the boat which may be a ladder or a gate.

Reed switches 16 and 18, are associated with movable elements on a boat 30, shown partially in FIG. 2, that travel from latched to unlatched positions. For example, reed switch 16 is shown in FIG. 2 as being attached to a gate 32 connected to rail 34 by hinge 36. Reed switch 16 possesses a permanent magnet 38 which operates reed switch 16. Typically, reed switch 16 is activated when magnet 38 lies between two and four centimeters therefrom. It should be noted that magnet 40 is associated with reed switch 18 in the same manner. It should be realized, that gate 32 is merely an illustration of a movable element associated with boat 30. For example, movable elements in the form of ladders, hatches, portholes, and other items may also be employed in this regard. Where reed switch 16 exists alone, activation of the same is sufficient to permit the operation of ignition switch 42 through the relay 14 which completes the circuit between battery 26 and marine engine 22. Where a plurality of reed switches, such as switches 16 and 18, are employed, all switches must be activated to achieve the same result. That is to say, all gates, ladders, portholes, and the like that are fitted with reed switches, such as reed switch 16, must be closed.

Figure 3:
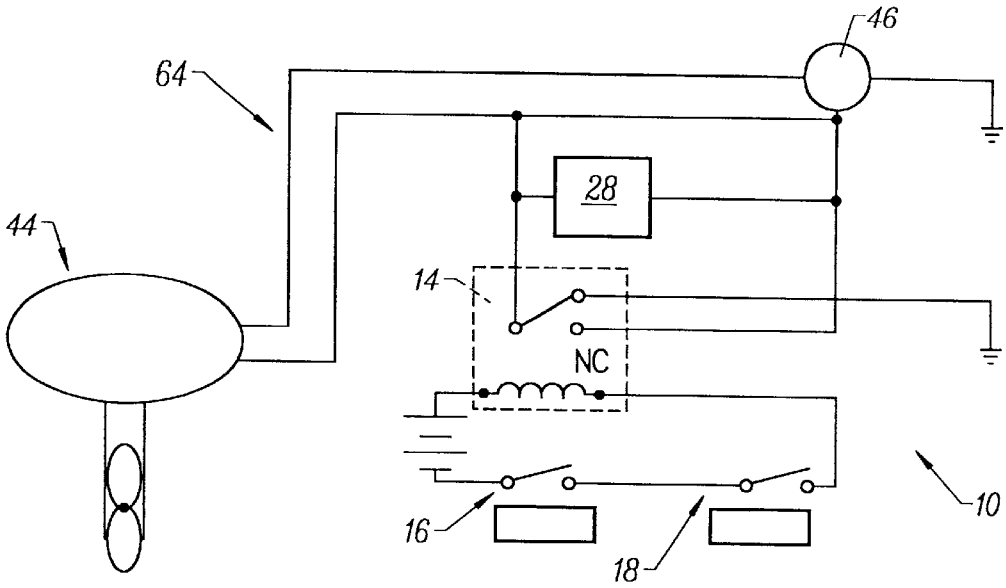
FIG. 3 is another schematic of the present invention in an outboard motor system for a boat.

Turning to FIG. 3, it may be observed that system 10 of the present invention is also applicable to a marine engine 44 which employs a magneto type ignition, such as those commonly found on an outboard engine. In such a case, a relay 14 is again employed in which reed switches 16 and 18 are similarly installed in boat 30, as is depicted in FIGS. 1 and 2. Relay 14 is normally closed when reed switches 16 and 18 are closed which would then permit the ignition switch 46 to start engine 44. Engine 44 may be cranked manually or through a battery. Again, when any real switch 16 or 18 is opened relay 14 grounds or shorts ignition switch 46 preventing switch 46 from starting motor 44. This "non-start" configuration is shown in FIG. 3. Override device 28 would shunt the connection normally made to relay 14 and permit connection switch to operate in a normal manner.

Figure 4:
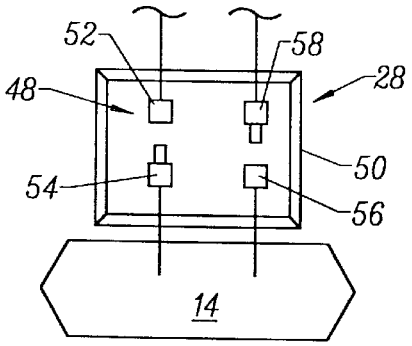
FIG. 4 is a detail describing the override system of the present invention for an inboard motor.

Referring to FIG. 4, it may be observed that relay 14 and override device 28 may take the form of a plurality of manually mated electrical connectors 48. Such connectors 48 are found in a housing 50, FIG. 4, preferably in the vicinity of the operator of boat 30. For example, with respect to the circuit depicted in FIG. 1, FIG. 4 shows a typical override device 28 in which female electrical connector 52 is normally connected to male connector 54. Also, female connector 56 is normally connected to male connector 58 to activate relay 14, reed switches 16 and 18, of the safety system 10 hereinbefore described. The connecting of male connector 58 to female connector 52, following disconnection of the connectors 48 as depicted in FIG. 4, would override the blocking effect of reed switches 16 and 18 and permit ignition switch 42 to operate in a normal manner.

Figure 5:
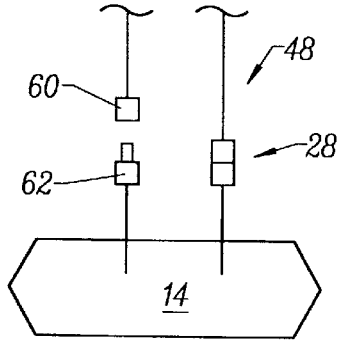
FIG. 5 is a detail schematic showing the override system when applied to an outboard motor.

Likewise, with respect to FIG. 5, an override system 28 is depicted in which female connector 60 is simply disconnected from male connector 62 into relay 14. Ignition switch 46 will then be permitted to operate in a normal manner with respect to outboard motor 44.

In operation, the user may simply install system 10 in an existing ignition circuit 20 with respect to an engine 22 depicted in FIG. 1, which may be an inboard engine, by placing relay 14 in one leg of the ignition circuit 20 associated with ignition switch 42. Reed switches 16 and 18 are installed at gates, ladders, latches, and the like in conjunction with permanent magnets 38 and 40 as depicted in FIG. 2. When the movable elements, such as gate 32, are unlatched, reed switches 16 and 18 remain open breaking the circuit to ignition switch 42 and preventing its operation with respect to marine engine 22. However, when reed switches 16 and 18 are closed due to the vicinity of permanent magnets 38 and 40, relay 14 will close the circuit permitting ignition switch 42 to operate in a normal manner. Likewise, with respect to FIG. 3, an outboard motor ignition circuit 64 is depicted in which relay 14 and reed switches 16 and 18 operate in a similar manner. Until reed switches 16 and 18 are closed, the marine engine 44 is grounded. The closing of reed switches 16 and 18 remove such ground and permits ignition switch 46 to activate circuit 64, allowing motor 44 to be started by manual cranking or battery means (not shown). Override device 28 would remove the ground associated with relay 14 and permit switch 46 to operate in a normal manner. Most importantly, override device 28 consists of manual connectors 48 which must be manually and electrically disconnected, with respect to the embodiment shown in FIG. 5, and reconnected with respect to the embodiments shown in FIG. 4. Such manual matable electrical connectors may be kept in a housing 50 for protection and to prevent unauthorized use. When override device 28 is employed, which may be due to a malfunction of reed switches 16 and 18, the operator of the boat must enter housing 50 disconnect and reconnect, as the case may be, the matable connectors 48, to permit boat 30 to operate. This elaborate procedure adds a great degree of safety to the operation of system 10 since a simple override switch is too easily engaged and may cause injury to persons in the water. It should be noted that housing 10 may be coupled with indicia to warn the operator of the boat to survey the water in the immediate vicinity of the boat before overriding ignition circuit 20 or 64 through override device 28.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A safety system for a boat having a motor driving propeller including an element movable between a latched and an unlatched position for gaining access to the boat, and an ignition circuit for the motor, comprising:

a. a switch in series in the ignition circuit normally in a closed position, said switch being opened when the movable element is opened to the unlatched position, said switch interrupting the ignition circuit;

b. an override device for said switch, said override device including first connector means and second connector means, said first and second connector means normally being mechanically electrically connected by manual mating to activate said switch associated with said movable element to permit the ignition circuit to start the motor, said first and second connector means further permitting the ignition circuit to start the motor when said first and second connector means are mechanically and electrically disconnected, by interrupting said manual mating and are mechanically and electrically configured to complete the ignition circuit without said operation of switch.

2. The safety system of claim 1 in which additionally comprises a relay, said first and second connector means being normally mechanically and electrically linked to said switch and said relay.

3. The safety system of claim 1 in which said first connector means comprises a first connector element and said second connector means comprises a second connector element, said first and second connector elements being electrically linked to one another only when said first and second connector elements are mechanically linked to each other.

4. The safety system of claim 3 in which said first and second connector means further comprises a third connector element and a fourth connector element, respectively, said third connector element being electrically and mechanically linked to said fourth connector element only when said first and second connector elements are electrically and mechanically linked to each other to permit the operation of said switch in the ignition circuit.

5. The safety system of claim 1 in which said movable element is a gate.

6. The safety system of claim 1 in which said movable element is a ladder.

7. The safety system of claim 1 in which said override device further includes a housing for said first and second connector means.

8. The safety system of claim 7 in which additionally comprises a relay, said first and second connector means being normally mechanically and electrically linked to said switch and said relay.

9. The safety system of claim 7 in which said first connector means comprises a first connector element and said second connector means comprises a second connector element, said first and second connector elements being electrically linked to one another only when said first and second connector elements are mechanically linked to each other.

10. The safety system of claim 9 in which said first and second connector means further comprises a third connector element and a fourth connector element, respectively, said third connector element being electrically and mechanically linked to said fourth connector element only when said first and second connector elements are electrically and mechanically linked to each other to permit the operation of said switch in the ignition circuit.

11. The safety system of claim 7 in which said movable element is a gate.

12. The safety system of claim 7 in which said movable element is a ladder.

* * * * *